US005984070A

United States Patent [19]

Briggs et al.

[11] Patent Number: 5,984,070

[45] Date of Patent: Nov. 16, 1999

[54] OVERHEATING PROTECTION DEVICE FOR ROTATIONAL CONTROL APPARATUS

[75] Inventors: Bradley R. Briggs, Eagan; William R. Daniels, New Germany, both of Minn.

[73] Assignee: Horton, Inc., Minneapolis, Minn.

[21] Appl. No.: 09/141,921

[22] Filed: Aug. 28, 1998

[51] Int. Cl.[6] ..... F16D 19/00; F01D 7/02

[52] U.S. Cl. ..... 192/85 R; 123/41.11

[58] Field of Search ..... 192/85 R, 82 T, 192/91 A, 85 A; 123/41, 41.11; 91/392, 393, 355

[56] References Cited

U.S. PATENT DOCUMENTS

| | | | |
|---|---|---|---|
| 1,988,413 | 1/1935 | Bing | 192/150 |
| 2,211,971 | 8/1940 | Flanders | 123/198 |
| 2,798,465 | 7/1957 | Nicholson | 123/41.15 |
| 4,189,095 | 2/1980 | Monigold et al. | 236/92 |
| 4,355,710 | 10/1982 | Schilling | 192/91 A |
| 4,376,473 | 3/1983 | Tomasek et al. | 192/3.58 |
| 4,393,966 | 7/1983 | Kono et al. | 192/150 X |
| 4,502,579 | 3/1985 | Makita | 192/52 |
| 4,722,426 | 2/1988 | Bellanger | 192/33 |
| 4,785,689 | 11/1988 | Iwatsuki et al. | 74/866 |
| 4,877,118 | 10/1989 | Tamura | 192/103 R |
| 5,188,136 | 2/1993 | Kumagai | 134/66 |
| 5,243,829 | 9/1993 | Bessler | 62/126 |
| 5,380,244 | 1/1995 | Tipton | 454/57 |
| 5,398,794 | 3/1995 | Walberg et al. | 192/85 A |
| 5,401,212 | 3/1995 | Marvell et al. | 454/187 |
| 5,457,965 | 10/1995 | Blair et al. | 62/129 |
| 5,765,672 | 6/1998 | Briggs et al. | 192/85 R |

FOREIGN PATENT DOCUMENTS

| | | |
|---|---|---|
| 136415 | 7/1979 | Germany . |
| 1120461 | 5/1989 | Japan . |
| 2235513 | 3/1991 | United Kingdom . |

*Primary Examiner*—Rodney H. Bonck
*Assistant Examiner*—Tisha D. Waddell
*Attorney, Agent, or Firm*—Alan Kamrath; Oppenheimer Wolff & Donnelly

[57] ABSTRACT

A device (10) is disclosed for intercepting the input of a system (23) of an internal combustion engine (12) normally provided to a solenoid valve (22) for actuating a fan clutch (20). A pressure switch (24) is provided in the pressure line between the solenoid valve (22) and the fan clutch (20). The input is received by terminals (27, 28) and is passed on to a transistor (53) which turns on and allows current flow to the solenoid valve (22) during a first period of time. If a second transistor (48) turns on because the pressure switch (24) remains open as a set point is not sensed in the pressure line and does not discharge a time delay circuit formed by a combination of a resistor (44) and a capacitor (46), then the voltage of the gate of the first transistor (53) is pulled down to turn the transistor (53) off and interrupt the current flow to the solenoid valve (22). When the current flow to the solenoid valve (22) is interrupted, the solenoid valve (22) exhausts the fluid pressure, and actuation of the fan clutch (20) is interrupted.

20 Claims, 2 Drawing Sheets

OVERHEATING PROTECTION DEVICE FOR ROTATIONAL CONTROL APPARATUS

BACKGROUND

The present invention generally relates to overheating protection devices for rotational control apparatus and especially for rotational control apparatus for controlling air flow, specifically to overheating protection devices for fan clutches; and particularly to overheating protection devices for fan clutches for internal combustion engines.

U.S. Pat. No. 5,398,794 discloses an overheating protection device in the form of a thermal fuse for a fan clutch. Retrofitting existing fan clutches with the thermal fuse of U.S. Pat. No. 5,398,794 would be possible but generally may not be very practical because of the large number of types and configurations of existing fan clutches.

U.S. Pat. No. 5,765,672 shows an overheating protection device for interrupting actuation of a fan clutch in the event that the fan is unable to rotate for any reason. In the preferred form disclosed therein, the device has particular application when rotation is prevented by interference of the radiator and/or shroud with the fan, bearing failure in the fan clutch, and other like conditions and senses rotation of the fan by sensing the movement of air as the result of the fan rotation.

However, another reason of interface slippage in the fan clutch is low actuation air pressure. Specifically, the air pressure may be insufficient to move the interface against the bias of the springs, with the springs biasing the interfacing surfaces either together or apart. In either case, low actuation air pressure results in slippage between the interfacing surfaces.

Thus, a need continues to exist for overheating protection devices which may be easily retrofitted for use with existing fan clutches to remove the risk of reduced operational life for the friction interface disc, the friction facing, and other clutch components and to remove the risk of overheating of surrounding cooling components such as the fan belts as the result of interface slippage in the fan clutch. In this regard, a need exists for overheating protection devices which prevent actuation of or multiple attempts to actuate the fan clutch under low fluid actuation pressure.

SUMMARY

The present invention solves these needs and other problems in the field of overheating protection devices for rotational control apparatus by providing, in the preferred form, interruption of the actuation of the rotational control apparatus in the event that a set point pressure of the actuation fluid to the rotational control apparatus is not sensed.

In other aspects of the present invention, actuation of a fan is interrupted in the event that a set point pressure of the actuation fluid is not sensed between a solenoid valve and a fan clutch. In preferred forms, pressure is sensed through the use of a pressure switch and actuation of the fan clutch is interrupted after a time delay after the initiation of an electrical signal supplied by an electrical system.

According to the teachings of the present invention, an electric circuit which receives the electrical signal provided by the electrical system allows current flow to the solenoid valve until a delay time has expired and after the delay time has expired only when a pressure switch senses actuation fluid pressure greater than a set point and for interrupting actuation of the current flow to the solenoid valve in the event that the pressure switch does not sense pressure at the set point.

It is thus an object of the present invention to provide a novel device for protecting rotational control apparatus from overheating.

It is further an object of the present invention to provide such a novel overheating protection device for a rotational control apparatus and especially a clutch and/or a brake.

It is further an object of the present invention to provide such a novel overheating protection device for a fan clutch for an internal combustion engine.

It is further an object of the present invention to provide such a novel overheating protection device which may be easily retrofitted in many existing environments.

It is further an object of the present invention to provide such a novel overheating protection device operable for apparatus actuable by providing an input signal having a voltage.

It is further an object of the present invention to provide such a novel overheating protection device operable with a fluid actuated apparatus which is either fluid engaged or fluid disengaged.

It is further an object of the present invention to provide such a novel overheating protection device operable with a normally closed solenoid for a fluid actuated apparatus.

It is further an object of the present invention to provide such a novel overheating protection device which interrupts current flow to the solenoid valve when the pressure of the actuation fluid controlled by the solenoid valve is low after sufficient time has passed after the solenoid valve is initially opened.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
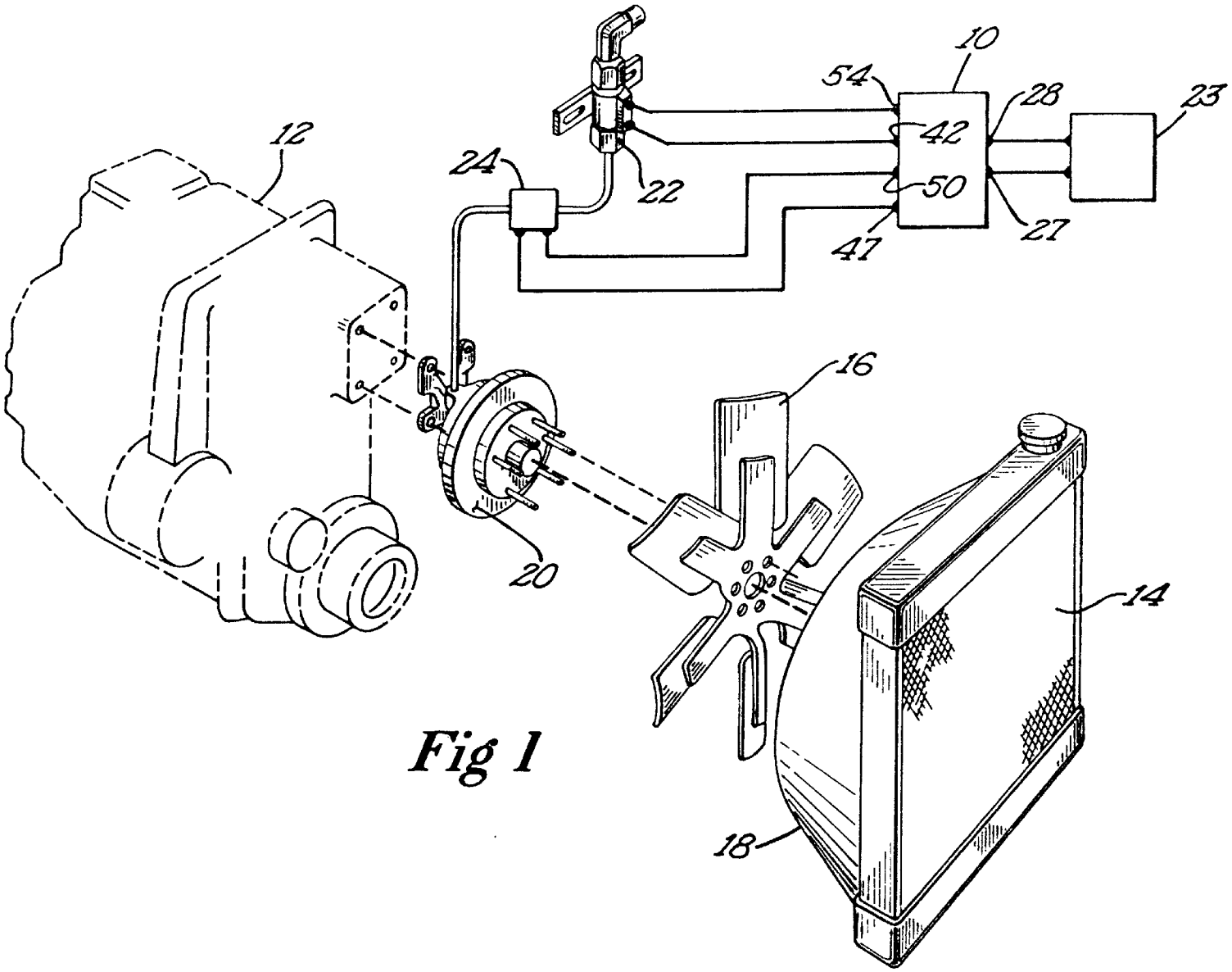
FIG. 1 shows a diagramatic view of an overheating protection device for a fan clutch for an internal combustion engine according to the preferred teachings of the present invention.
Figure 2:
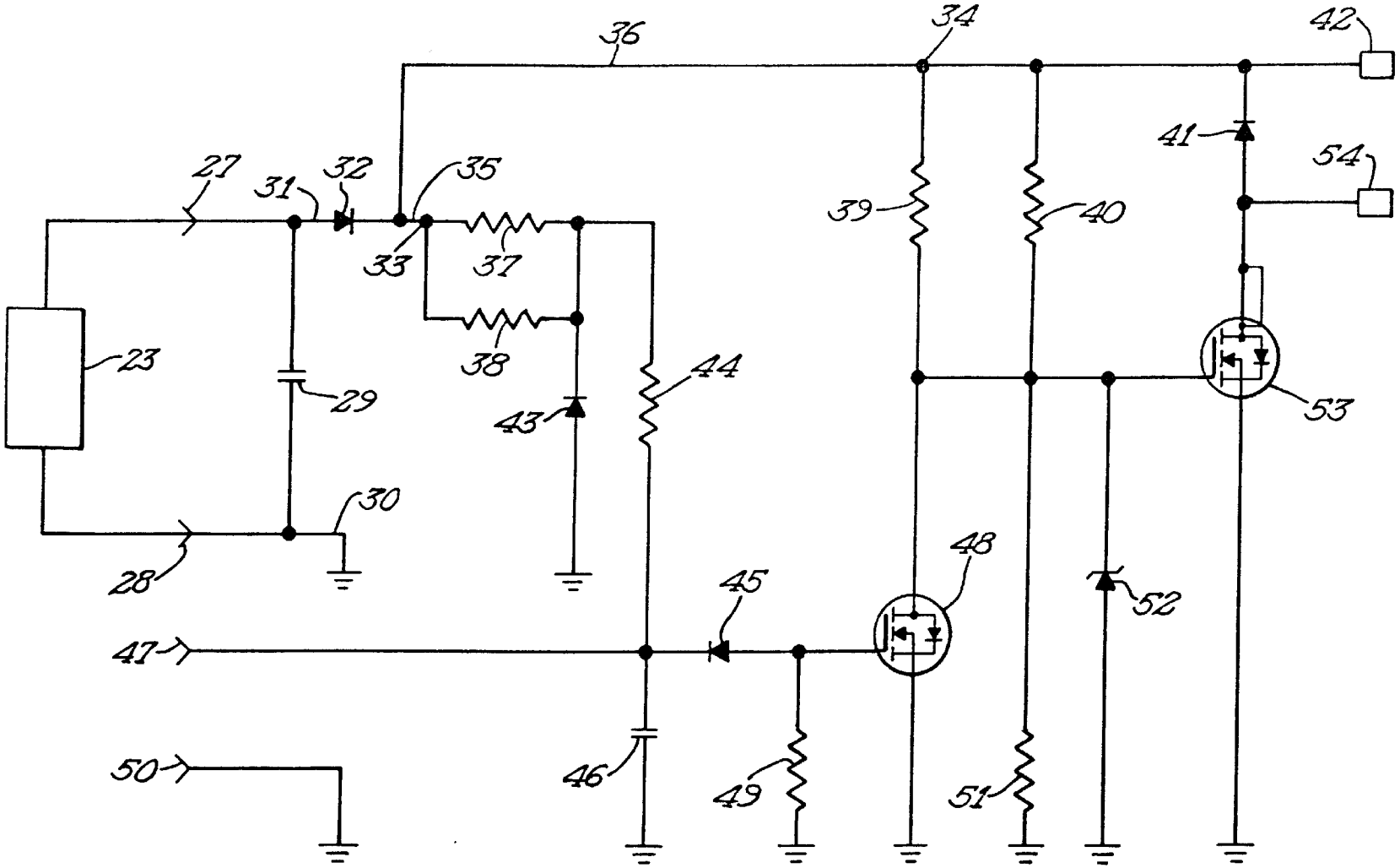
FIG. 2 shows an electrical schematic for the overheating protection device of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact values, dimensions and dimensional proportions to conform to specific electronic, electrical, force, weight, strength, and similar requirements will likewise be within the skill of the art after the following description has been read and understood.

Where used in the various figures of the drawings, the same numerals designate the same or similar parts. Furthermore, when the terms "first", "second", and similar terms are used herein, it should be understood that these terms have reference only to the structure shown in the drawings as it would appear to a person viewing the drawings and are utilized only to facilitate describing the illustrative embodiment.

DESCRIPTION

An overheating protection device for a fan clutch for an internal combustion engine such as for a truck, bus, or the like according to the preferred teachings of the present invention is shown in the drawings and generally designated 10. A common mode of providing power to a truck, bus, or the like is an internal combustion engine 12 having a cooling system generally including a radiator 14 through which coolant is circulated. A fan 16 is provided for moving air through radiator 14 in a direction either drawing or pushing air through radiator 14. For directing air flow, fan 16 is positioned generally radially centrally within a shroud 18 secured to radiator 14.

As cooling requirements of engine 12 vary according to various factors including but not limited to ambient air temperature and speed, engine speed, and the like, it is common to provide a fan clutch 20 in the drive for fan 16 so that rotation of fan 16 can be varied according to the particular cooling requirements at any particular time. Fan clutch 20 includes a rotating input and a rotatable output for rotating fan 16 such as being mounted thereon. Fan clutch 20 is actuable from a disengaged condition where the input is free to rotate independent of the output to an engaged condition where the input is rotatably connected to the output such as directly. For purposes of explanation, fan clutch 20 will be of a fluid actuated type such as disclosed in U.S. Pat. Nos. 3,253,687; 3,409,305; 3,762,517; 4,226,095; 4,355,710; 4,425,993; 4,427,102; 4,445,605; 4,456,110; 4,460,079; 4,657,126; 4,877,117; and 5,059,161, which are hereby incorporated herein by reference.

In the case of fluid actuation, a solenoid valve 22 controls fluid flow to fan clutch 20 to either activate or deactivate fan clutch 20. Solenoid valve 22 can be controlled by an electrical system 23 such as an electronic control module, a thermostat switch, or similar switching device. In this regard and especially in applications other than for fan clutch 20 such as but not limited to industrial environments, electrical system 23 could be manually operated to open and close solenoid valve 22 such as by pushing a button or pulling a lever.

Device 10 is intended to work with valves 22 which are normally closed and to work with fan clutches 20 which are either fluid engaged or disengaged. For example, if valve 22 is normally closed and fan clutch 20 is spring disengaged, current must be supplied to valve 22 to open valve 22 allowing fluid pressure to engage clutch 20 thus causing fan 16 to rotate. On the other hand, if fan clutch 20 is spring engaged and valve 22 is normally closed, current must be interrupted to valve 22 to remain closed allowing the spring bias to engage fan clutch 20 thus causing fan 16 to rotate.

According to the preferred teachings of the present invention, a pressure switch 24 is provided in the pressure line between solenoid valve 22 and clutch 20. According to the preferred teachings of the present invention, switch 24 senses positive pressure and is not a vacuum switch. Additionally, switch 24 in the most preferred form is of the normally open type and closes when the pressure sensed exceeds a pressure set point which is factory set.

Device 10, according to the preferred teachings of the present invention, operates with any 12–30 volt electrical signal supplied by electrical system 23 connected to supply terminals 27 and 28 by conventional electrical wires. A 0.01 microfarad capacitor 29 for attenuating electrical noise is connected between terminals 27 and 28. Terminal 28 is further connected to ground by a lead 30. Terminal 27 is further connected by an electrical lead 31 and to the anode of diode 32 used for preventing damage from polarity reversal of electrical system 23. The cathode of diode 32 is connected to junction points 33 and 34 by leads 35 and 36, respectively. The first terminals of 3.9 kiloohm resistors 37 and 38 are connected to junction point 33, and the first terminals of 3.9 kiloohm resistors 39 and 40 are connected to junction point 34. Junction point 34 is also connected to the cathode of a diode 41 and to a first solenoid terminal 42. Diodes 32 and 41 are of the axial rectifier, standard recovery type.

The second terminals of resistors 37 and 38 are connected to the cathode of a diode 43 and the second terminal of a 33 kiloohm resistor 44. The anode of diode 43 is connected to circuit ground. The first terminal of resistor 44 is connected to the cathode of a diode 45, the positive terminal of a 100 microfarad capacitor 46, and a first pressure switch terminal 47. The negative terminal of capacitor 46 is connected to circuit ground. The anode of diode 45 is connected to the gate of a transistor 48 and the second terminal of a 100 kiloohm resistor 49. The first terminal of resistor 49 is connected to circuit ground. A second pressure switch terminal 50 is connected to circuit ground.

Resistors 37 and 38 act in parallel to reduce the current load to one half of what an individual resistor would handle. The first terminals of resistors 37 and 38 are the input to the time delay portion of the circuitry for device 10. Resistors 37 and 38 limit the current to diode 43. Diode 43 clamps the voltage at its cathode to a set voltage and specifically 8.2 Volts in the most preferred form. Diode 43 produces a constant voltage independent of the specified power signal voltage supplied by electrical system 23. Resistor 44 and capacitor 46 form the time delay circuit. Because diode 43 provides a constant voltage, the time delay will be constant despite variable voltage between electrical systems 23 of different types. Diode 45 is a 4.3 Volt zener diode and transistor 48 is a 2N7002 N-Channel Enhancement Mode Field Effect Transistor (FET). A FET was chosen because they are voltage activated as opposed to being current activated. Capacitor 46 begins charging up when the 8.2 Volts is present at the second terminal of resistor 44. Further, resistor 44 prolongs the charging time of capacitor 46 by limiting the current flow into capacitor 46. As the voltage at the junction of resistor 44 and capacitor 46 exceeds the zener voltage rating of diode 45, diode 45 begins to reverse conduct and the voltage at the gate of transistor 48 increases quickly until it exceeds the maximum threshold voltage rating of transistor 48. Transistor 48 then turns on and conducts current from its drain terminal to its source terminal. The zener voltage of diode 45 was chosen to be higher than the maximum threshold voltage of transistor 48. With the constant voltage applied to the resistor 44 and capacitor 46 time delay circuit which produces a constant charge time and diode 45 with its constant breakdown voltage, the time to turn on transistor 48 is also constant despite the 1 to 2.5 Volt threshold voltage range of transistor 48. When diode 45 is no longer reverse conducting, resistor 49 is used to discharge any remaining voltage from the anode of diode 45 and the gate of transistor 48.

Terminals 47 and 50 are the connection points for pressure switch 24. With pressure switch 24 being normally open, capacitor 46 is able to charge up when 8.2 Volts is present at the second terminal of resistor 44. When pressure switch 24 closes, it discharges capacitor 46 through terminals 47 and 50 back to the circuit ground. As long as pressure switch 24 is sensing pressures above its set point and thus is closed, then capacitor 46 remains uncharged and transistor 48 is off.

The source terminal of transistor 48 is connected to circuit ground. The drain terminal of transistor 48 is connected to the first terminals of resistor 39 and resistor 40, the second terminal of a 2 kiloohm resistor 51, the cathode of diode 52 and the gate of transistor 53. The source terminal of transistor 53 is connected to circuit ground. The drain terminals of transistor 53 are connected to a second solenoid terminal 54 and the anode of diode 41. The first terminal of resistor 51 is connected to circuit ground. The anode of diode 52 is connected to circuit ground. Terminals 42 and 54 are the connection points for the coil of solenoid valve 22.

When a voltage between 12 and 30 Volts D.C. is applied across terminals 27 and 28 by electrical system 23, that voltage less a voltage drop across diode 32 is seen at the second terminal of resistors 39 and 40 and at terminal 42. Resistors 39 and 40 form a voltage divider with resistor 51 so that the voltage at the gate of transistor 53 is approximately one half of the voltage across terminals 27 and 28. As long as the input voltage is at least 12 Volts and transistor 48 is off, then the voltage at the gate of transistor 53 will be higher than the threshold voltage of transistor 53 and transistor 53 will turn on. When transistor 53 is on, then current can flow from terminal 42 through the solenoid coil of valve 22, through terminal 54 and pass through the drain and source terminals of transistor 53 to the circuit ground. Thus, solenoid valve 22 turns on immediately when power is applied by electrical system 23 to the circuitry of device 10. Therefore, transistor 53 acts as a first switch responsive to initial receipt of the electrical signal from electrical system 23 and allows current flow to solenoid valve 22 during a first period of time.

If transistor 48 turns on because pressure switch 24 did not discharge the resistor 44—capacitor 46 time delay circuit, then the voltage of the gate of transistor 53 is pulled down below the minimum gate threshold voltage and transistor 53 turns off. Thus, the solenoid coil of valve 22 is off as well. Therefore; transistor 48 which is coupled to the time delay circuit and to transistor 53 acts as a second switch to disengage transistor 53 after the first period of time has elapsed in the event that pressure switch 24 does not sense pressure at the set point.

While transistor 48 is on, current is flowing through resistors 39 and 40. Resistors 39 and 40 are connected in parallel in order to share the current loading similar to resistors 37 and 38. Diode 52 is a transient voltage suppressor and will clamp fast acting voltage spikes below the maximum allowed gate voltage of transistor 53.

Summarizing, when it is desired to supply current flow through the solenoid coil of valve 22, power is applied across terminals 27 and 28 by electrical system 23. Transistor 53 is turned on immediately and thus valve 22 is turned on. With valve 22 on, air pressure is applied to clutch 20. At the same time, the time delay circuit is charging up. If the pressure to clutch 20 exceeds the set point of pressure switch 24 before transistor 48 can turn on, then transistor 53 will remain on as pressure switch 24 has discharged the timing circuit. However, if the pressure does not rise above the set point of pressure switch 24 before the timing circuit charges enough to turn on transistor 48, then transistor 53 and valve 22 will be turned off and the air pressure to clutch 20 will be exhausted.

Every time the power is applied to a previously unpowered circuit of device 10, valve 22 will turn on for at least the few seconds it takes for the time delay circuit to charge up. This is necessary so that air pressure can be applied to clutch 20. Further, if there was an air leak and the pressure could not exceed the set point of pressure switch 24, then the air would be exhausted and as long as device 10 is powered the circuit will not allow clutch 20 to re-actuate because there is no air pressure to pressure switch 24 and since switch 24 has no pressure, then valve 22 can not turn on. Thus, the circuit is inherently self latching. The circuitry of device 10 has to have the power removed and reapplied in order to actuate clutch 20 again.

It can now be appreciated that device 10 according to the preferred teachings of the present invention interrupts actuation of fan clutch 20 and prevents the actuation of fan clutch 20 in the event that the air pressure from valve 22 to fan clutch 20 is below the set point of pressure switch 24. If fan clutch 20 was continuously engaged under lower air pressure conditions, the resulting heat generated by the slippage between the input and the output of fan clutch 20 could ruin fan clutch 20 or otherwise shorten its operational life and could result in overheating of the surrounding components of engine 12 such as the fan belts connected to the input of fan clutch 20. Device 10 according to the teachings of the present invention is operable for various combinations of types of fan clutches 20, valves 22 and systems 23.

According to the teachings of the present invention, device 10 does not include any manually operated switches such as to turn on or off device 10 and does not include any indicators. This is advantageous especially in the fan clutch environment since it is not necessary for modifications to be made in the control panel such as in the dash of a truck cab if and when device 10 is desired to be installed in the control of the actuation of fan clutch 20. Additionally, device 10 does not require adjustment for particular applications or over time. Thus, installation can be performed by personnel without extensive electronic experience and without calibration, and installer or operator error as the result of incorrect adjustment is eliminated.

Additionally, it should be appreciated that device 10 provides control of actuation of fan clutch 20 according to the teachings of the present invention by an electric circuit and without the use of software. Thus, the component cost is substantially less in device 10 according to the teachings of the present invention than if programmable controllers were utilized. Likewise, the dependability and life of device 10 according to the teachings of the present invention are enhanced than if programmable controllers are utilized.

In the most preferred form, device 10 according to the preferred teachings of the present invention, is integrated into the housing for the coil of solenoid valve 22. However, it should further be appreciated that device 10 can be easily retrofitted for use with existing fan clutches 20 by the addition of pressure switch 24 and by simple insertion in the prior electrical connections to intercept the cooling request signal between already existing system 23 and already existing valve 22.

Now that the basic teachings of the present invention have been explained, many extensions and variations will be obvious to one having ordinary skill in the art. For example, in the preferred form, device 10 according to the teachings of the present invention has been shown and described in connection with fan clutch 20 for over the road truck and similar applications in sensing the rotation of fan blades 16. Specifically, in a preferred form, device 10 has particular application in the event that fan blades 16 (ie the output) is not free to rotate at the same speed as the input because the torque on the fan blades is greater than the torque transferred at the interface surfaces of fan clutch 20 as the result of low air pressure which is insufficient to move the interface surfaces against a spring bias resulting in slippage between the interface surfaces when attempting to move interface surfaces between engaged and disengaged conditions. However, it can be appreciated that such features can be utilized in a variety of other applications according to the teachings of the present invention including but not limited to for industrial clutches, brakes, and similar rotational control apparatus. As a single example, device 10 would have particular application to a spring engaged and air released brake and especially an emergency stop brake where low air pressure may be insufficient to fully disengage the brake resulting in slippage and heat generation, with device 10 preventing the brake from being disengaged (or attempted to be disengaged) under low actuation pressure. In this regard, when utilized with a spring actuated and air released rotational control apparatus, device 10 according to the teachings of the present invention provides fail safe engagement in the event of low air pressure as pressure required for release is exhausted by solenoid valve 22.

Similarly, although device 10 has been described in the preferred form utilized in connection with an air actuated rotational control apparatus in the most preferred form of fan clutch 20, device 10 according to the teachings of the present invention could be utilized with rotational control apparatus including fan clutches 20 which are actuated by other types of fluid.

Likewise, although the timing delay circuit of device 10 has been shown and described as including resistor 44 and capacitor 46, device 10 according to the teachings of the present invention can include time delay circuits of other forms including but not limited to thermal time delay switches.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

We claim:

1. Device comprising, in combination:

a fan;

a fluid actuated fan clutch having an output connected to the fan;

an electrical system providing an electrical signal having a voltage;

a solenoid valve controlling fluid flow to the fan clutch;

a pressure switch for sensing the pressure of the fluid flow between the solenoid valve and the fan clutch; and means for receiving the electrical signal provided by the electrical system and for allowing current flow to the solenoid valve to actuate the fan clutch until a delay time has expired and after the delay time has expired only when the pressure switch senses pressure greater than a set point and for interrupting the current flow to the solenoid valve in the event that the pressure switch does not sense pressure at the set point.

2. The device of claim 1 wherein the receiving, allowing, and interrupting means comprises circuit means for providing an interruptable current flow to the solenoid valve, with the circuit means being free of a programmable controller.

3. The device of claim 2 wherein the circuit means comprises, in combination:

first switching means responsive to initial receipt of the electrical signal and allowing current flow to the solenoid valve during a first period of time;

timing means for providing a time delay signal when the first period of time has elapsed; and second switching means coupled to the timing means and to the first switching means and acting to disengage the first switching means after the first period of time has elapsed in the event the pressure switch does not sense pressure at the set point.

4. Device for interrupting the actuation of a fluid actuated rotational control apparatus by an electrical system providing an electrical signal having a voltage comprising, in combination:

a solenoid valve controlling fluid flow to the rotational control apparatus;

a pressure switch for sensing the pressure of the fluid flow between the solenoid valve and the rotational control apparatus; and circuit means for receiving the electrical signal provided by the electrical system and for allowing current flow to the solenoid valve until a delay time has expired and after the delay time has expired only when the pressure switch senses pressure greater than a set point and for interrupting the current flow to the solenoid valve in the event that the pressure switch does not sense pressure at the set point.

5. The device of claim 4 wherein the circuit means comprises, in combination:

first switching means responsive to initial receipt of the electrical signal and allowing current flow to the solenoid valve during a first period of time;

timing means for providing a time delay signal when the first period of time has elapsed; and second switching means coupled to the timing means and to the first switching means and acting to disengage the first switching means after the first period of time has elapsed in the event the pressure switch does not sense pressure at the set point.

6. The device of claim 5 wherein the circuit means further comprises, in combination:

a zener diode for providing a constant voltage to the timing means to assure a constant delay time for a range of electrical signals.

7. The device of claim 6 wherein the timing means comprises a combination of a resistor and a capacitor.

8. The device of claim 7 wherein the first switching means and the second switching means comprise N-channel field effect transistors.

9. The device of claim 8 wherein the circuit means further comprises, in combination:

a voltage divider having an input connected to the electrical signal and an output connected to a gate terminal of the first switching means to assure that the first switching means is energized for electrical signals of at least 12 volts.

10. The device of claim 9 wherein the circuit means comprises, in combination:

a zener diode connected between an output of the timing means and a gate of the second switching means.

11. The device of claim 10 for interrupting actuation of a clutch.

12. The device of claim 11 for interrupting actuation of a fan clutch.

13. The device of claim 12 for interrupting actuation of an air actuated fan clutch.

14. The device of claim 5 wherein the timing means comprises a combination of a resistor and a capacitor.

15. The device of claim 5 wherein the first switching means and the second switching means comprise N-channel field effect transistors.

16. The device of claim 5 wherein the circuit means further comprises, in combination:

a voltage divider having an input connected to the electrical signal and an output connected to a gate terminal of the first switching means to assure that the first switching means is energized for electrical signals of at least 12 volts.

17. The device of claim 5 wherein the circuit means comprises, in combination:

a zener diode connected between an output of the timing means and a gate of the second switching means.

18. The device of claim 4 for interrupting actuation of a clutch.

19. The device of claim 4 for interrupting actuation of a fan clutch.

20. The device of claim 4 for interrupting actuation of an air actuated fan clutch.

* * * * *